US010655653B2

(12) United States Patent
Bedrossian et al.

(10) Patent No.: US 10,655,653 B2
(45) Date of Patent: May 19, 2020

(54) REUSABLE GAS GENERATOR DRIVEN PRESSURE SUPPLY SYSTEM

(71) Applicant: Bastion Technologies, Inc., Houston, TX (US)

(72) Inventors: Nazareth Bedrossian, Dickinson, TX (US); Charles D. Coppedge, Brewer, ME (US); Randel L. Hoskins, Woodinville, WA (US)

(73) Assignee: Bastion Technologies, Inc., Houston, TX (US)

( * ) Notice: Subject to any disclaimer, the term of this patent is extended or adjusted under 35 U.S.C. 154(b) by 40 days.

(21) Appl. No.: 16/103,455

(22) Filed: Aug. 14, 2018

(65) Prior Publication Data

US 2019/0048901 A1 Feb. 14, 2019

Related U.S. Application Data

(60) Provisional application No. 62/545,293, filed on Aug. 14, 2017.

(51) Int. Cl.
*F15B 15/19* (2006.01)
*F15B 11/072* (2006.01)
(Continued)

(52) U.S. Cl.
CPC ..... *F15B 15/19* (2013.01); *E21B 33/0355* (2013.01); *E21B 34/16* (2013.01);
(Continued)

(58) Field of Classification Search
CPC .... F15B 11/0725; F15B 15/19; F15B 21/005; F15B 2211/218
(Continued)

(56) References Cited

U.S. PATENT DOCUMENTS 2,011,144 A * 8/1935 Coffman ..... H01H 39/002 60/634
2,979,094 A 4/1961 Royer
(Continued)

FOREIGN PATENT DOCUMENTS

CN 100419214 C 9/2008
CN 101377150 B 6/2012
(Continued)

OTHER PUBLICATIONS

PCT/US2018/046739 corresponding to U.S. Appl. No. 16/103,455, International Search Report and Written Opinion, dated Oct. 18, 2018.

*Primary Examiner* — Michael Leslie
(74) *Attorney, Agent, or Firm* — Winstead PC; Henry Ehrlich

(57) ABSTRACT

An exemplary method includes using a pressure supply device (PSD) to actuate a hydraulic customer includes activating, when in the first position, a first gas generator of the multiple gas generators thereby driving the piston to the second position, pressurizing the hydraulic fluid, and discharging the pressurized hydraulic fluid to the customer; actuating the customer in response to receiving the pressurized hydraulic fluid; resetting the piston to first position by transferring a resetting hydraulic fluid into the reservoir; and exhausting gas and condensate from the gas chamber in response to resetting the piston to the first position.

20 Claims, 8 Drawing Sheets

(51) Int. Cl.

| | |
|---|---|
| ***F04B 9/123*** | (2006.01) |
| ***E21B 34/16*** | (2006.01) |
| ***E21B 33/035*** | (2006.01) |
| ***F15B 21/00*** | (2006.01) |

(52) U.S. Cl.
CPC ..... *F04B 9/123* (2013.01); *F15B 11/0725* (2013.01); *F15B 21/005* (2013.01); *F15B 2201/20* (2013.01); *F15B 2211/218* (2013.01)

(58) Field of Classification Search
USPC ..... 91/5; 60/634
See application file for complete search history.

(56) References Cited

U.S. PATENT DOCUMENTS

| | | | | | |
|---|---|---|---|---|---|
| 3,018,627 | A | | 1/1962 | Perricci | |
| 3,031,845 | A | | 5/1962 | Ludwig | |
| 3,077,077 | A | | 2/1963 | Jones | |
| 3,100,058 | A | | 8/1963 | Peet | |
| 3,100,965 | A | | 8/1963 | Blackburn | |
| 3,236,046 | A | | 2/1966 | Wellman | |
| 3,762,160 | A | * | 10/1973 | Kramer | F15B 11/02 91/5 |
| 3,886,745 | A | | 6/1975 | Kaida et al. | |
| 3,933,338 | A | | 1/1976 | Herd et al. | |
| 4,074,527 | A | | 2/1978 | Sadler | |
| 4,163,477 | A | | 8/1979 | Johnson et al. | |
| 4,308,721 | A | | 1/1982 | Thomas et al. | |
| 4,412,419 | A | | 11/1983 | Thomas et al. | |
| 4,461,322 | A | | 7/1984 | Mills | |
| 4,619,111 | A | | 10/1986 | Whiteman | |
| 4,777,800 | A | | 10/1988 | Hay, II | |
| 4,815,295 | A | | 3/1989 | Narum | |
| 5,004,154 | A | | 4/1991 | Yoshida et al. | |
| 5,029,776 | A | * | 7/1991 | Jakubowski | F15B 15/19 60/634 |
| 5,072,896 | A | | 12/1991 | McIntyre et al. | |
| 5,316,087 | A | | 5/1994 | Manke et al. | |
| 5,481,977 | A | | 1/1996 | Evans et al. | |
| 5,647,734 | A | | 7/1997 | Milleron | |
| 6,202,753 | B1 | | 3/2001 | Baugh | |
| 6,418,970 | B1 | | 7/2002 | Deul | |
| 6,817,298 | B1 | | 11/2004 | Zharkov et al. | |
| 7,011,722 | B2 | | 3/2006 | Amtower, II | |
| 7,231,934 | B2 | | 6/2007 | Biester | |
| 7,721,652 | B2 | | 5/2010 | Yoshida et al. | |
| 7,810,569 | B2 | | 10/2010 | Hill et al. | |
| 8,453,575 | B2 | | 6/2013 | Humbert et al. | |
| 8,544,271 | B2 | * | 10/2013 | Dreyer | F15B 15/19 60/634 |
| 8,616,128 | B2 | | 12/2013 | Sampson | |
| 9,856,889 | B2 | | 1/2018 | Wilie | |
| 10,066,643 | B2 | * | 9/2018 | Coppedge | F15B 11/08 |
| 10,267,264 | B2 | * | 4/2019 | Coppedge | E21B 41/00 |
| 2005/0218359 | A1 | | 10/2005 | Davis et al. | |
| 2009/0178433 | A1 | | 7/2009 | Kumakura et al. | |
| 2009/0211239 | A1 | | 8/2009 | Askeland | |
| 2010/0206389 | A1 | | 8/2010 | Kennedy et al. | |
| 2011/0108285 | A1 | | 5/2011 | Fagley, IV et al. | |
| 2011/0284237 | A1 | | 11/2011 | Baugh | |
| 2012/0048566 | A1 | | 3/2012 | Coppedge et al. | |
| 2012/0111572 | A1 | | 5/2012 | Cargo, Jr. | |
| 2013/0220161 | A1 | | 8/2013 | Coppedge et al. | |
| 2013/0220627 | A1 | | 8/2013 | Coppedge et al. | |
| 2013/0220637 | A1 | | 8/2013 | Fabela et al. | |
| 2016/0138524 | A1 | | 5/2016 | Coppedge et al. | |
| 2016/0138617 | A1 | | 5/2016 | Coppedge et al. | |
| 2016/0168936 | A1 | | 6/2016 | Carisella et al. | |

FOREIGN PATENT DOCUMENTS

| | | | |
|---|---|---|---|
| DE | 102007001645 | A1 | 7/2008 |
| EP | 0009346 | A1 | 4/1980 |
| GB | 2523079 | A | 8/2015 |

* cited by examiner

REUSABLE GAS GENERATOR DRIVEN PRESSURE SUPPLY SYSTEM

BACKGROUND

This section provides background information to facilitate a better understanding of the various aspects of the disclosure. It should be understood that the statements in this section of this document are to be read in this light, and not as admissions of prior art.

Pre-charged hydraulic accumulators are used in many different industrial applications to provide a source of hydraulic pressure and operating fluid to actuate devices such as valves. It is common for installed hydraulic accumulators to be connected to or connectable to a source of hydraulic a reserve pressure source to recharge the pressure loss due to leakage.

SUMMARY

An exemplary method includes using a pressure supply device (PSD) to actuate a hydraulic customer, the PSD including a cylinder extending from a first end to a discharge end, a moveable piston disposed in the cylinder and separating a reservoir from a gas chamber, multiple gas generators in communication with the gas chamber, the hydraulic customer in communication with the reservoir, wherein in a first position the piston is located proximate to the first end and the reservoir contains hydraulic fluid, and in a second position the piston is located proximate to the discharge end. The using including activating, when in the first position, a first gas generator of the multiple gas generators thereby driving the piston to the second position, pressurizing the hydraulic fluid, and discharging the pressurized hydraulic fluid to the customer; actuating the customer in response to receiving the pressurized hydraulic fluid; resetting the piston to first position by transferring a resetting hydraulic fluid into the reservoir; and exhausting gas and condensate from the gas chamber in response to resetting the piston to the first position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
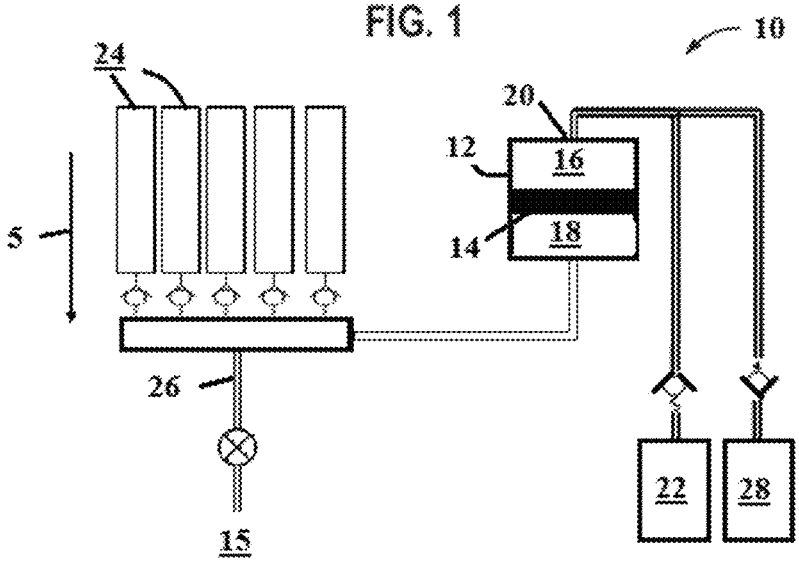
FIG. 1 illustrates an exemplary reusable gas generator driven pressure supply device according to one or more aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "inboard," "outboard, "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

FIG. 1 illustrates an example of a reusable gas generator driven pressure supply device (PSD), also referred to as a pyrotechnic accumulator, generally denoted by the numeral 10. Pyrotechnic accumulator 10 includes a cylinder 12 with a moveable piston 14 separating a reservoir 16 for holding hydraulic fluid from a gas chamber 18. Reservoir 16 includes a port 20 for connection with a hydraulically operated customer 22. One or more gas generators 24 are in communication with gas chamber 18 to drive piston 14 and pressurize the hydraulic fluid to power customer 22.

Gas generators 24 are pyrotechnic-type devices using a propellant charge to produce a pressurized gas. Gas chamber 18 includes a vent 26 to exhaust the condensate formed when the produced gas cools and to exhaust the spent gas, e.g., the cooled and reduced pressure gas. In use, the spent gas and condensate are exhausted to a dump 15, which may be for example the environment or a vessel. In operation, reservoir 16 is in communication with an external hydraulic fluid source 28 to reset pyrotechnic device 10. External hydraulic fluid source 28 may be component of customer 22, e.g., the customer control system. Resetting pyrotechnic accumulator 10 includes filling reservoir 16 with hydraulic fluid, driving piston 14 back to the first position, and exhausting the condensate and gas out of gas chamber 18. The resetting hydraulic fluid may be the same volume of hydraulic fluid used to actuate the customer or it may be new hydraulic fluid.

In some embodiments, for example in a wellbore installation, cylinder 12 is oriented vertically as represented by gravity 5 and multiple pyrotechnic accumulators 10 may be arranged together in a pod or module. In some embodiments, cylinder 12 is oriented horizontally or at an angle between horizontal and vertical.

Figure 2:
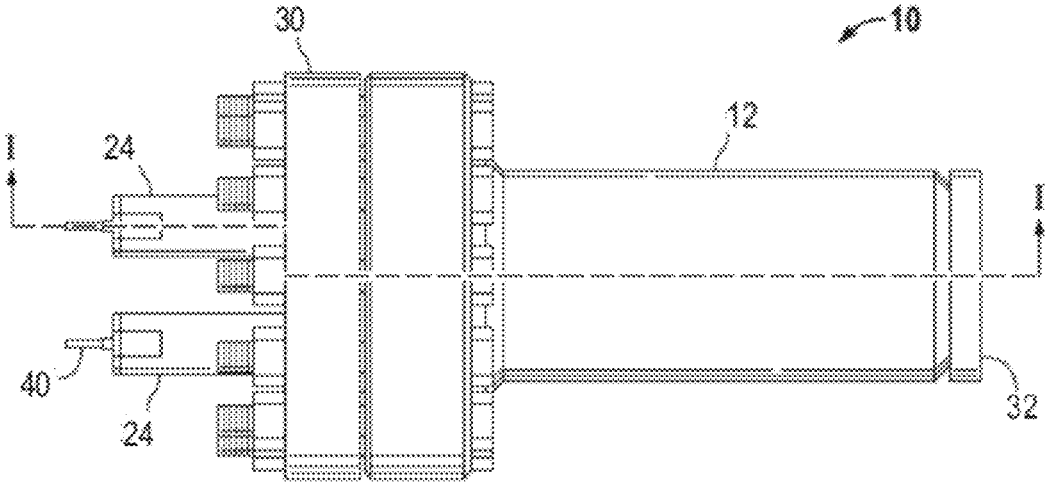
FIG. 2 illustrates another exemplary reusable gas generator driven pressure supply device according to one or more aspects of the disclosure.
Figure 3:
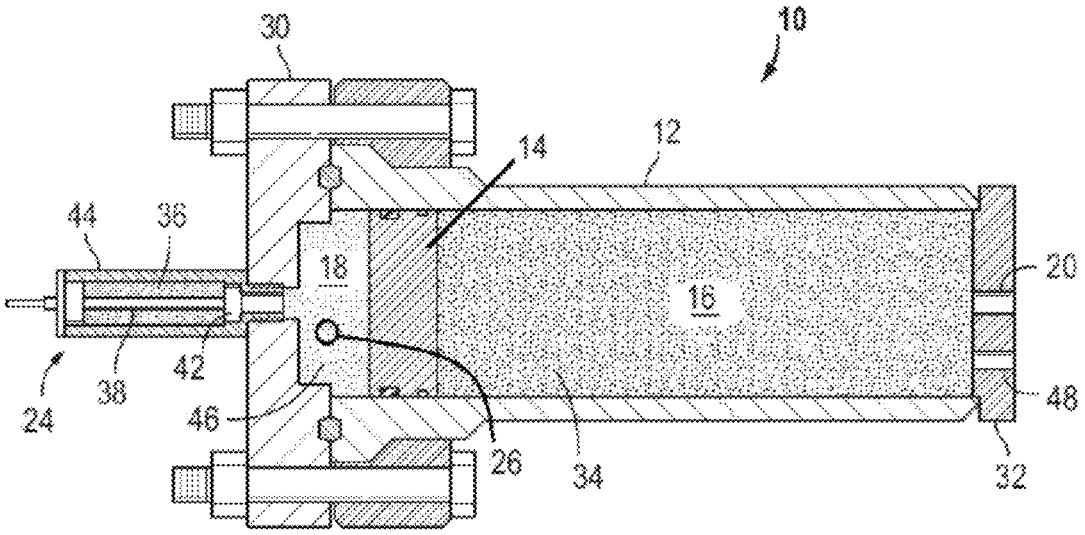
FIG. 3 is a cut-away view along the line I-I of the reusable gas generator driven pressure supply device of FIG. 3 according to one or more aspects of the disclosure.

FIGS. 2 and 3 illustrate an example of a pyrotechnic accumulator 10. Cylinder 12 extends axially from a first or gas end 30 to a discharge end 32. Cylinder 12 may be constructed of one or more sections. In this example, gas generators 24 are connected directly to gas end 30 and in communication with gas chamber 18. Reservoir 16, e.g., hydraulic chamber, is filled with a fluid 34, e.g., non-compressible oil, water, or gas. Fluid 34 is generally described herein as a hydraulic fluid, however, it is understood that a gas can be used in some embodiments. Fluid 34 is not pre-charged and stored in cylinder 12 at the working pressure of hydraulically operated customer 22. Pyrotechnic accumulator 10 stores hydraulic fluid 34 at a pressure lower than the working pressure of customer 22. Fluid 34 is pressurized to the working pressure on demand to actuate customer 22 by igniting a gas generator 24. The spent gas 46 and condensate are exhausted from gas chamber 18 through vent 26.

Figure 4:
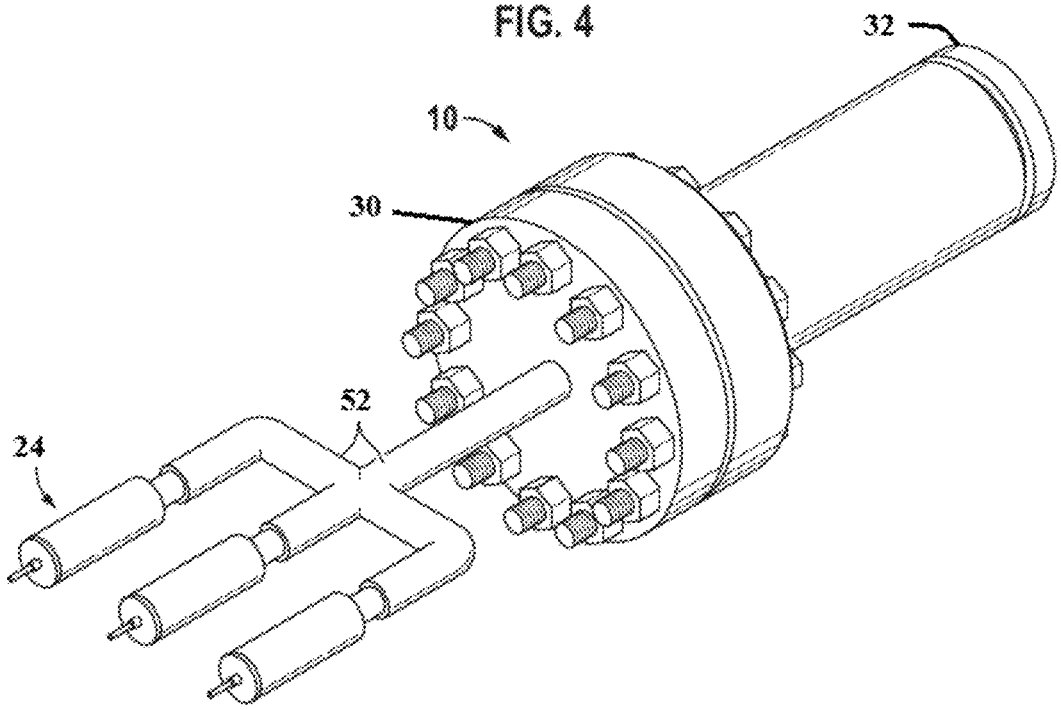
FIG. 4 illustrates another exemplary reusable gas generator driven pressure supply device according to one or more aspects of the disclosure.

FIG. 4 illustrates another example of a pyrotechnic accumulator 10. In this example, multiple gas generators 24 are connected to gas end 30 through a manifold 52 in communication with the gas chamber in cylinder 12.

In FIGS. 1-4, multiple gas generators 24 are in communication with gas chamber 18. In some embodiments, a single gas generator 24 may be in communication with gas chamber 18. In some embodiments, gas generators 24 are located in gas chamber 18. The illustrated gas generators 24 are a pyrotechnic type of gas generator having a propellant 36. Propellant 36 may be for example a solid propellant. Illustrated pressure generators 24 comprise an initiator 38, e.g., ignitor, connected to propellant 36 and extending via an electrical conductor to an electrical connector 40. An example gas generator 24 is a cartridge with propellant 36 located in a breech chamber 42 of a housing 44.

In a first position, piston 14 is located proximate first end 30 with a full volume of reservoir 16 filled with hydraulic fluid 34. Ignition of gas generator 24 produces a high-pressure, high-temperature gas 46 that expands in gas chamber 18 thereby pushing piston 14 toward discharge end 32, pressurizing fluid 34, and discharging fluid 34 through port 20 to customer 22 (FIG. 1). Piston 14 is located at a second or end position proximate discharge end 32 after pressurized fluid 34 has been discharged from reservoir 16. In a reset process, resetting hydraulic fluid is transferred from an external hydraulic fluid source 28 into reservoir 16 through port 20 or port 48 driving piston 14 back to the first position and exhausting spent gas 46 and condensate out of gas chamber 18 through vent 26.

Figure 5:
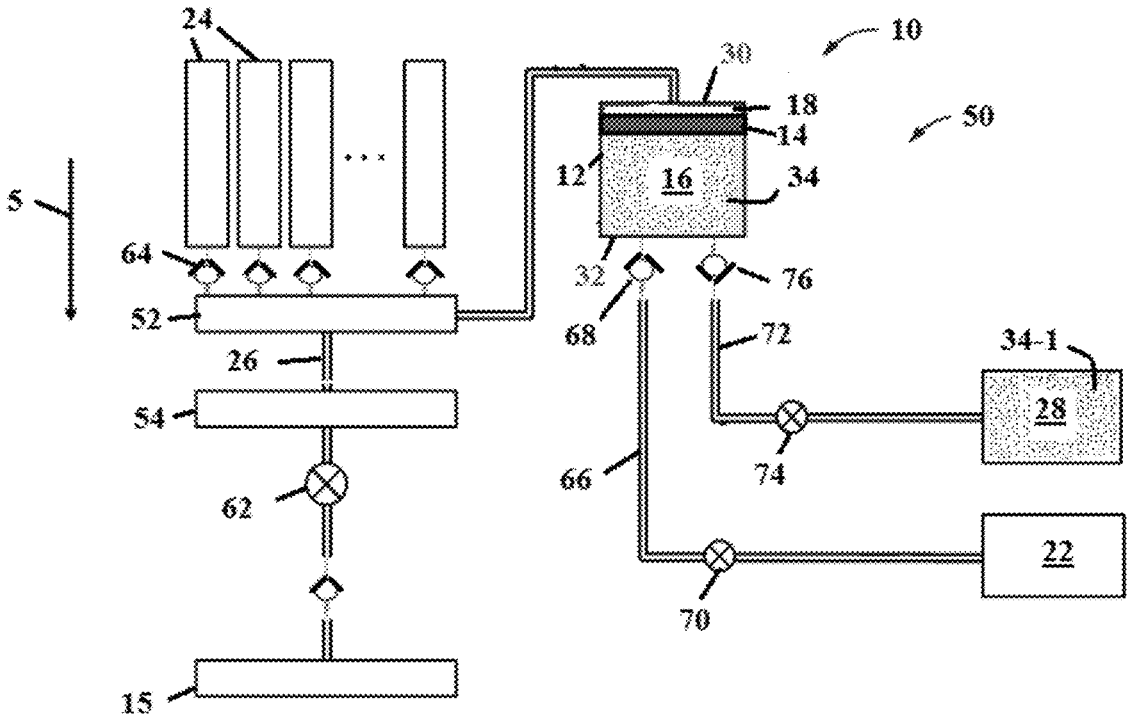
FIG. 5 illustrates an exemplary gas generator driven pressure supply system according to one or more aspects of the disclosure.
Figure 6:
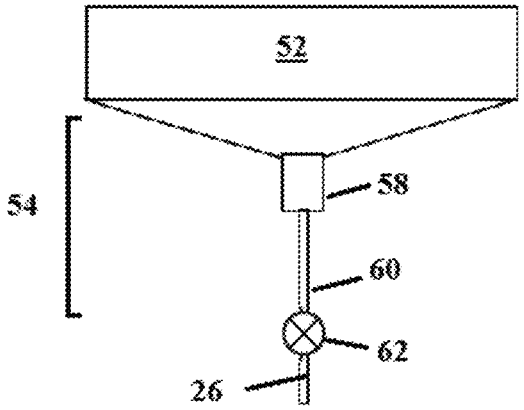
FIG. 6 illustrates an exemplary condensate trap incorporated in a gas generator driven pressure supply system according to one or more aspects of the disclosure.
Figure 7:
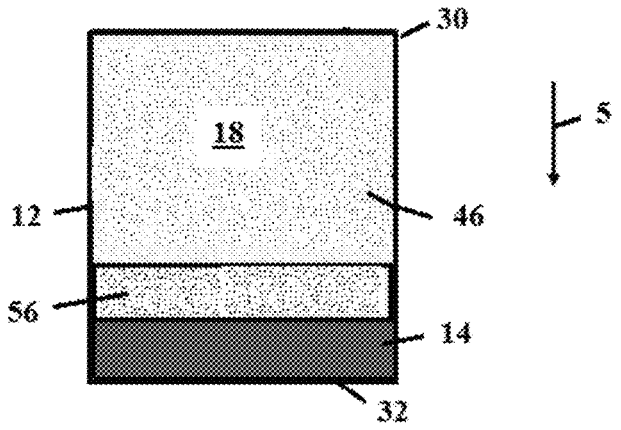
FIG. 7 illustrates an example of a cylinder of a gas generator driven pressure supply device in a second position according to one or more aspects of the disclosure.

FIGS. 5-7 illustrate an example of a gas generator driven pressure supply system 50 described with additional reference to the other figures. Cylinder 12 is oriented vertically relative to gravity 5 with gas chamber 18 elevated above reservoir 16. Multiple gas generators 24 are in communication with gas chamber 18 through a manifold 52. In an exemplary embodiment, at least gas end 30 is elevated above manifold 52. A condensate trap 54 is in communication with gas chamber 18 through vent 26 and positioned at a lower elevation than gas chamber 18 and manifold 52. Piston 14 is in the first position in FIG. 5 and in the second position in FIG. 7. In the second position, condensate 56 settles in cylinder 12 below spent gas 46.

FIG. 6 illustrates an example manifold 52 incorporating a condensate trap 54. When piston 14 is being reset from the second position in FIG. 7 to the first position in FIG. 5, spent gas 46 is exhausted first through vent 26 leaving a volume of condensate 56 in manifold 52. Condensate in the gas chamber will reduce the efficiency and performance of the subsequent gas generators. The condensate will reduce the temperature of the produced gas and thus reduce the generated pressure; therefore, additional propellant may be needed in subsequent gas generator activations to achieve a desired working pressure. Condensate trap 54 is configured to reduce and minimize the surface area of condensate 56 that is exposed to produced gas 46 of the later-activated gas generators 24 and thereby minimize the effects of condensate 56 on produced gas 46. This is accomplished by having narrow openings in condensate trap 54 that expose a small surface area of condensate 56 to produced gas 46. For example, with reference to FIG. 6, condensate trap 54 includes a reduction in cross-section, moving down in elevation through vent 26, from manifold 52 to a gas trap neck 58 and an additional reduction in cross-section, moving down in elevation, from gas trap neck 58 to liquid trap 60. Condensate trap 54 is located in vent 26, e.g., conduit, between manifold 52 and a vent valve 62 in this example.

In the depicted system 50, a one-way flow control device 64 is located between each gas generator 24 and gas chamber 18. One-way flow control devices 64 prevent the flow of produced gas 46 from one gas generator 24 into the empty volume of a previously fired gas generator 24 and into a yet to be fired gas generator 24.

Reservoir 16 is in communication with hydraulically operated customer 22 through a conduit 66. Hydraulically operated customer 22 includes without limitation a valve, ram, or piston, which can be incorporated in one or more devices and systems. In some embodiments, conduit 66 includes a one-way flow control device 68 to prevent the discharged pressurized hydraulic fluid from returning to reservoir 16, for example in response to produced gas 46 cooling. In FIG. 5, conduit 66 also includes a customer valve 70.

Reservoir 16 is in communication with an external hydraulic fluid source 28 through a reset conduit 72 having a reset valve 74. External hydraulic fluid source 28 contains a volume of reset hydraulic fluid 34-1 to replace hydraulic fluid 34 that is discharged to actuate customer 22. Reset conduit 72 includes a one-way flow control device 76 to block flow of hydraulic fluid 34 from reservoir 16 into external hydraulic fluid source 28. In an embodiment, external hydraulic fluid source 28 is a component of customer 22. In some embodiments, external hydraulic fluid source 28 is separate from customer 22, for example a pre-pressurized hydraulic accumulator or remote pump.

A method of operating gas generator driven pressure supply system 50 of FIG. 5 is described with reference to FIGS. 1-7. In the first position, pyrotechnic accumulator 10 is ready to actuate customer 22 upon activation. Vent valve 62 is closed to keep produced gas 46 from prematurely escaping to dump 15. Reset valve 74 is closed to block hydraulic fluid flow from external hydraulic fluid source 28, and customer valve 70 is open to allow pressurized hydraulic fluid 34 to flow from reservoir 16 to customer 22, e.g. a ram of tubular shear, blowout preventer ram, a control system, a blowout preventer control system.

In response to a command, for example from a controller, to actuate customer 22, a first gas generator 24 is ignited producing gas 46 which fills manifold 52, condensate trap 54, and expands in gas chamber 18. The expanding produced gas 46 drives piston 14 from the first position toward discharge end 32, pressurizing hydraulic fluid 34 which is discharged through a port 20 and through conduit 66 to actuate customer 22. Customer 22 is actuated in response to receiving pressurized hydraulic fluid 34 discharged from pyrotechnic accumulator 10. Customer valve 70 is closed when piston 14 is fully extended to the second position (FIG. 7) and customer 22 has been actuated. In a cool down period, produced gas 46 cools, the pressure of produced gas 46 declines, and liquid condenses leaving condensate 56 and spent gas 46 on the gas side of pyrotechnic accumulator 10. In the FIG. 5-7 example, cylinder 12 is elevated relative to manifold 52 so that condensate 56 collects in condensate trap 54 due to gravity.

Reset of pyrotechnic accumulator 10 to the first position is initiated by opening vent valve 62 and reset valve 74. Reset hydraulic fluid 34-1 flows from external hydraulic fluid source 28 through reset conduit 72 into reservoir 16. Reset hydraulic fluid 34-1 drives piston 14 from the second position to the first position exhausting gas 46 and condensate 56 through manifold 52 and open vent valve 62 to dump 15. In this example, dump 15 is the environment. External hydraulic fluid source 28 does not supply hydraulic fluid 34-1 at or above the operating pressure of customer 22, but at a pressure sufficient to overcome the backpressure of dump 15. For example, in a subsea installation the resetting hydraulic fluid 34-1 must overcome the hydrostatic head at the installation depth of a dump 15 open to the environment. Condensate 56 remaining on the gas side of system 50 when piston 14 is reset to the first position collects in condensate trap 54. At the end of the reset period, vent valve 62 and reset valve 74 are closed, and customer valve 70 is opened. System 50 is now reset to the initial position and ready for the next gas generator 24 to be ignited to actuate customer 22. In some embodiments, for example a closed hydraulic system, reset hydraulic fluid 34-1 is the same volume of hydraulic fluid 34 that was pressurized and discharged to customer 22.

Figure 8:
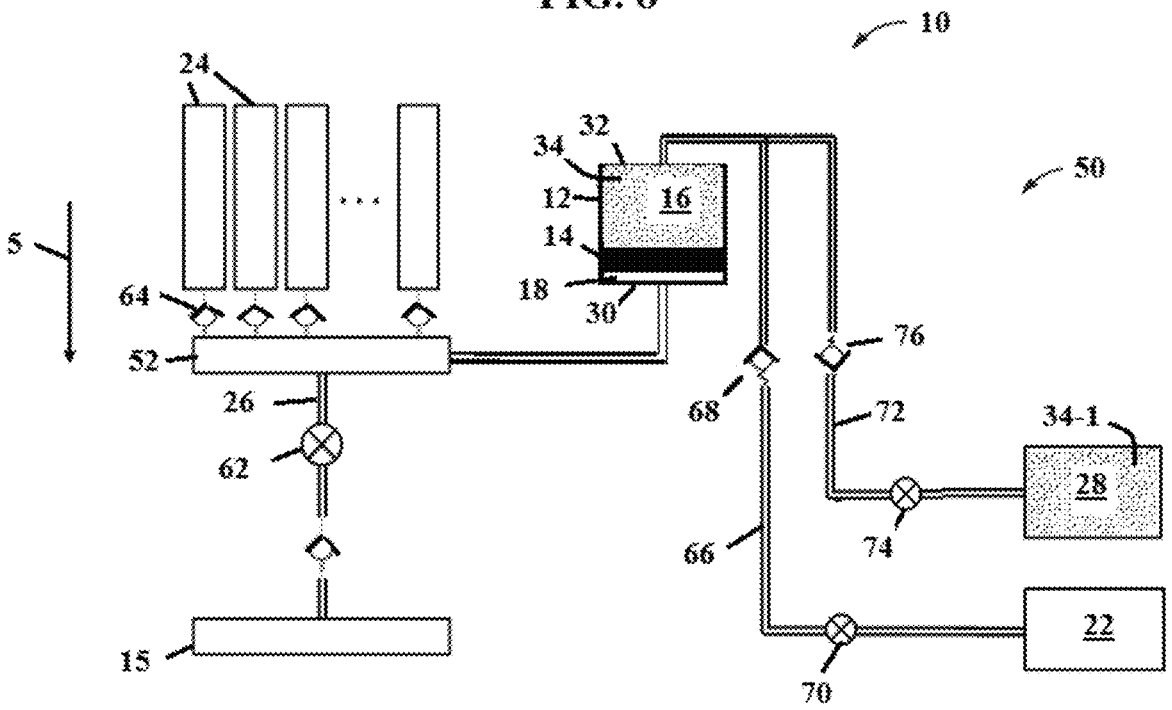
FIG. 8 illustrates another exemplary gas generator driven pressure supply system according to one or more aspects of the disclosure.
Figure 9:
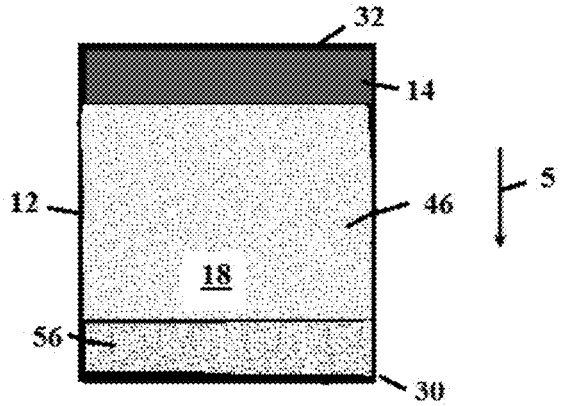
FIG. 9 illustrates an example of a cylinder of a gas generator driven pressure supply device in a second position according to one or more aspects of the disclosure.

FIGS. 8 and 9 illustrate another exemplary gas generator driven pressure supply system 50 described with additional reference to the other figures. System 50 does not include a condensate trap and cylinder 12 is oriented vertically with reservoir 16 elevated above gas chamber 18. Gas chamber 18 is elevated relative to manifold 52. As shown in FIG. 9, condensate 56 settles in cylinder 12 below produced gas 46 when piston 14 is in the second position.

A method of operating gas generator driven pressure supply system 50 of FIG. 8 is described with reference in particular to FIGS. 8-9. In the first position, shown in FIG. 8, vent valve 62 is closed to prevent produced gas 46 from being prematurely exhausted to dump 15, reset valve 74 is closed to block hydraulic fluid flow from external hydraulic fluid source 28 into reservoir 16, and customer valve 70 is open. Upon demand to operate customer 22, a first gas generator 24 is activated producing a high-temperature, high-pressure gas 46. Produced gas 46 drives piston 14 toward the second position at discharge end 32, pressurizing and discharging hydraulic fluid 34 to customer 22. Customer valve 70 is closed after piston 14 is moved to the second position and customer 22 has been actuated. Condensate 56 forms as produced gas 46 cools.

Vent valve 62 and reset valve 74 are opened to reset of pyrotechnic device 10 to the first position. Resetting to the first position, includes transferring resetting hydraulic fluid 34-1 from external hydraulic fluid source 28 into reservoir 16, driving piston 14 the first position proximate first end 30, and exhausting condensate 56 and spent gas 46 through vent 26 to dump 15. Due to the configuration of system 50 of FIGS. 8 and 9, condensate 56 is driven through vent valve 62 ahead of produced gas 46. With piston 14 reset to the first position, vent valve 62 and reset valve 74 are closed, and customer valve 70 is opened.

Figure 10:
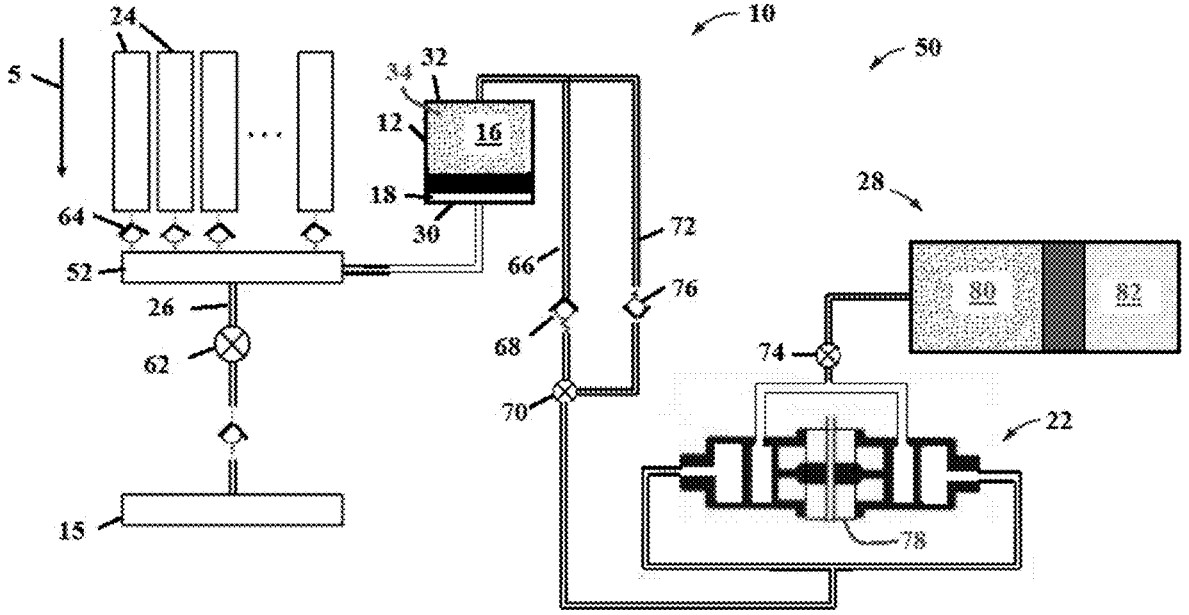
FIG. 10 illustrates another exemplary gas generator driven pressure supply system according to one or more aspects of the disclosure.

FIG. 10 illustrates another example a gas generator driven pressure supply system 50 described with additional reference to the other figures. In this example, customer 22 is a blowout preventer (BOP) connected with a wellbore 78. The hydraulic side of system 50 is closed and external hydraulic fluid source 28 is a reference pressure hydraulic accumulator in communication with blowout preventer 22. Dump 15 is an enclosed vessel.

A method of operation of system 50 illustrated in FIG. 10 includes, with system 50 and pyrotechnic device 10 in the first position, closing vent valve 62, opening a flow path, e.g., conduit 66, between reservoir 16 and blowout preventer 22, and opening reset valve 74 positioned between blowout preventer 22 and external hydraulic fluid source 28 serving as a reference pressure source. In the FIG. 10 example, customer valve 70 is a multiple direction valve controlling a hydraulic fluid flow path, via conduits 66 and 72, between reservoir 16 and blowout preventer 22. In some embodiments, customer conduit 66 and reset conduit 72 may be single conduit without one-way flow control devices.

External hydraulic fluid source 28 includes a hydraulic fluid 80 in communication with an exhaust of blowout preventer 22 and pressurized by a spring 82, e.g., gas or mechanical. External hydraulic fluid source 28 is precharged, and may be recharged, to a specified pressure selected for example on the volume of dump vessel 15 and the number of times that it is desired to reset pyrotechnic accumulator 10. The pressure required to reset pyrotechnic accumulator 10 to the first position increases each time gas 46 is exhausted to dump vessel 15. In the FIG. 10 embodiment, hydraulic fluid 34 is not vented to the environment when blowout preventer 22 is actuated, therefore, system 50 may not be depth compensated in a subsea installation.

When first gas generator 24 is activated, produced gas 46 drives piston 14 toward discharge end 32, pressurizing hydraulic fluid 34 and discharging it to blowout preventer 22. In response to receiving pressurized hydraulic fluid 34, blowout preventer 22 is actuated and exhausts reference hydraulic fluid 80 to external hydraulic fluid source 28. When piston 14 is in the second position and blowout preventer 22 has been actuated, reset valve 74 is closed and the flow path between reservoir 16 and blowout preventer 22 is closed. During the cool down period, produced gas 46 cools, the pressure of produced gas 46 declines, and condensate 56 forms and collects for example as illustrated in FIG. 9. Cylinder 12 is shown in FIG. 10 with reservoir 16 elevated above gas chamber 18, however, it may be oriented vertically with gas chamber 18 on top as shown in FIGS. 5 and 7, or cylinder 12 may be oriented horizontally or at an angle between horizontal and vertical.

To reset pyrotechnic accumulator 10, vent valve 62 is opened, reset valve 74 is opened, and the flow path, e.g. through conduit 72, between customer 22 and reservoir 16 is opened. Pressurized reference hydraulic fluid 80 flows from external hydraulic fluid source 28 to blowout preventer 22 thereby actuating, e.g. resetting, blowout preventer 22. Resetting blowout preventer 22 exhausts hydraulic fluid 34 from blowout preventer 22 into reservoir 16, e.g., through conduit 72, thereby driving piston 14 to the first position and resetting pyrotechnic accumulator 10. Driving piston 14 to the first position exhausts condensate 56 and spent gas 46 through vent 26 and vent valve 62 to dump 15.

Figure 11:
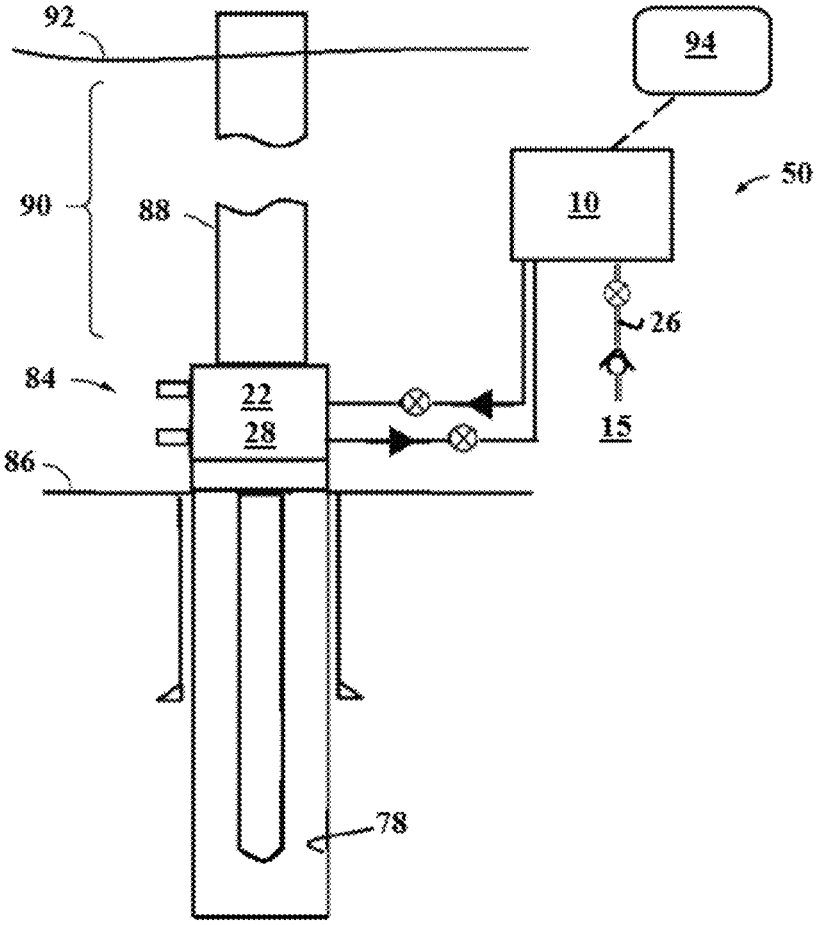
FIG. 11 illustrates a wellbore system incorporating a gas generator driven pressure supply system according to one or more aspects of the disclosure.

FIG. 11 illustrates a wellbore system 84 incorporating a gas generator driven pressure supply system 50, which is described with reference to FIGS. 1-10. System 50 includes a pyrotechnic accumulator 10 with multiple gas generators 24 according to aspects of FIGS. 1-10. Wellbore 78 extends from a seafloor 86. A riser 88 forms wellbore 78 from seafloor 86 through water column 90 to water surface 92. Customer 22 is in connection with wellbore 78. In this example, customer 22 is a ram device. Reusable pyrotechnic accumulator 10 is located subsea proximate to seafloor 86.

Gas generator driven pressure supply system 50 includes a controller 94 that may be located subsea, above water surface 92, and/or at a remote location on land. Controller 94 is in operational connection with system 50 to activate gas generators 24 on a demand to actuate customer 22, and to reset system 50 to the first position.

In an exemplary system 50, customer 22 is a casing shear (ram device) such as a Cameron 18¾ inch TL SuperShear, which requires a minimum of 72 gallons of hydraulic fluid to close at a maximum working pressure of 5,000 psi in less than 45 seconds. Reservoir 16 is sized to dispose 72 gallons of hydraulic fluid 34 when piston 14 is in the first position. Gas generators 24 may each include a solid propellant weight of approximately 54 pounds. In an example, for a minimum operational capacity, solid propellant 36 may be a cylindrical shape of approximately 7 inches in diameter and 27 inches in length and disposed for example in housing 44 having a cylindrical shape of about 8 inches in diameter and 38 inches in length.

Figure 12:
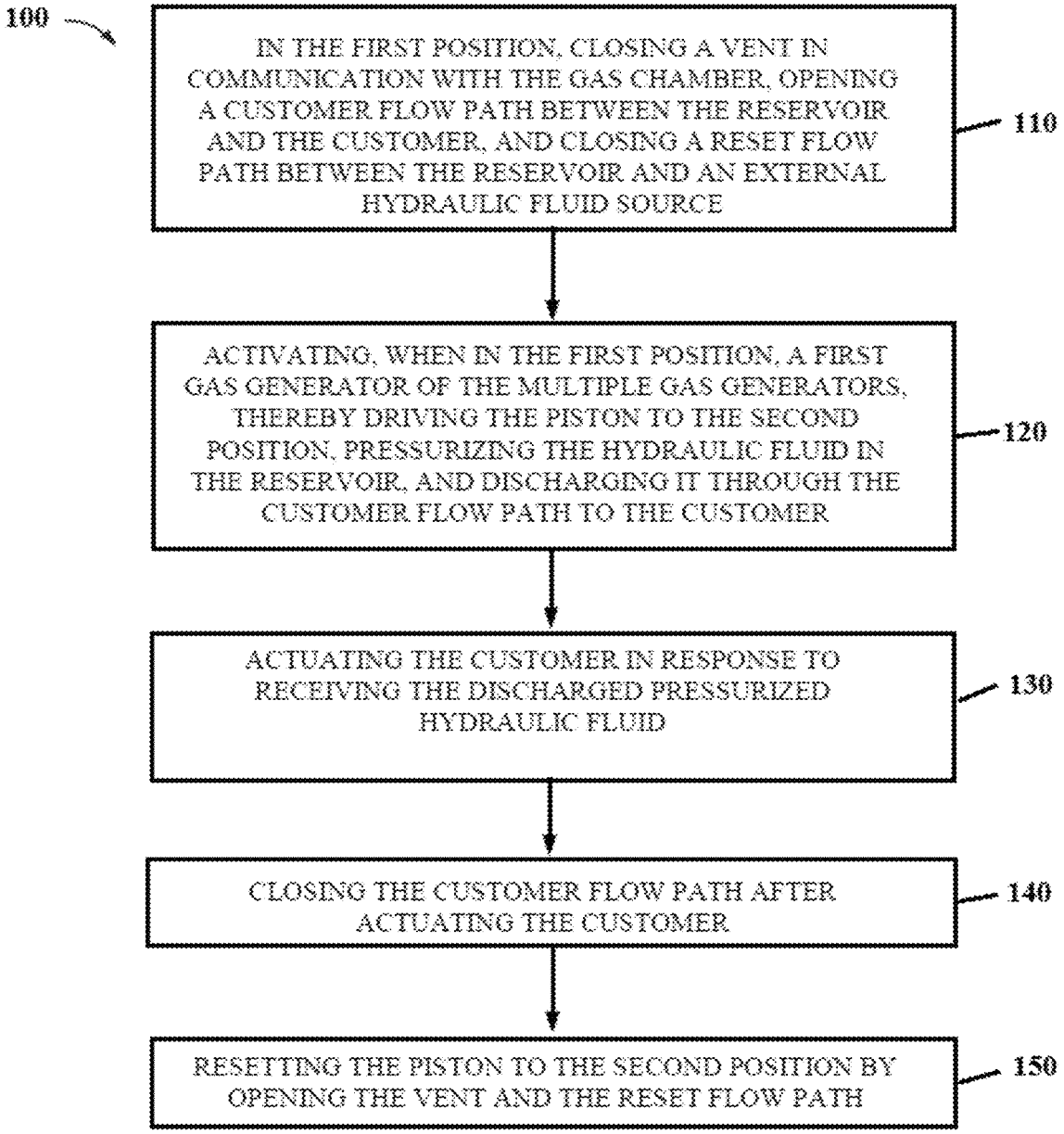
FIG. 12 illustrates an exemplary method of operating a gas generator driven pressure supply system according to one or more aspects of the disclosure.

FIG. 12 illustrates an exemplary method 100, which is described with reference to FIGS. 1-11. At block 110, with a pressure supply device 10 in the first position, closing a vent 26 in communication with gas chamber 18, opening a customer flow conduit 66 between reservoir 16 and customer 22, and closing a reset flow path 72 between reservoir 16 and an external hydraulic fluid source 28. At block 120, activating, when in the first position, a first gas generator 24 of the multiple gas generators producing gas 46 in gas chamber 18, thereby driving piston 14 to the second position, pressurizing hydraulic fluid 34 in reservoir 16 and discharging it through customer flow conduit 66 to customer 22. At block 130, actuating customer 22 in response to receiving the discharged pressurized hydraulic fluid 34. At block 140, closing customer flow conduit 66 after actuating customer 22. At block 150, resetting piston 14 to the second position by opening vent 26 and reset flow path 72, transferring resetting hydraulic fluid into reservoir 16 and exhausting gas 46 and condensate 46 from gas chamber 18.

Figure 13:
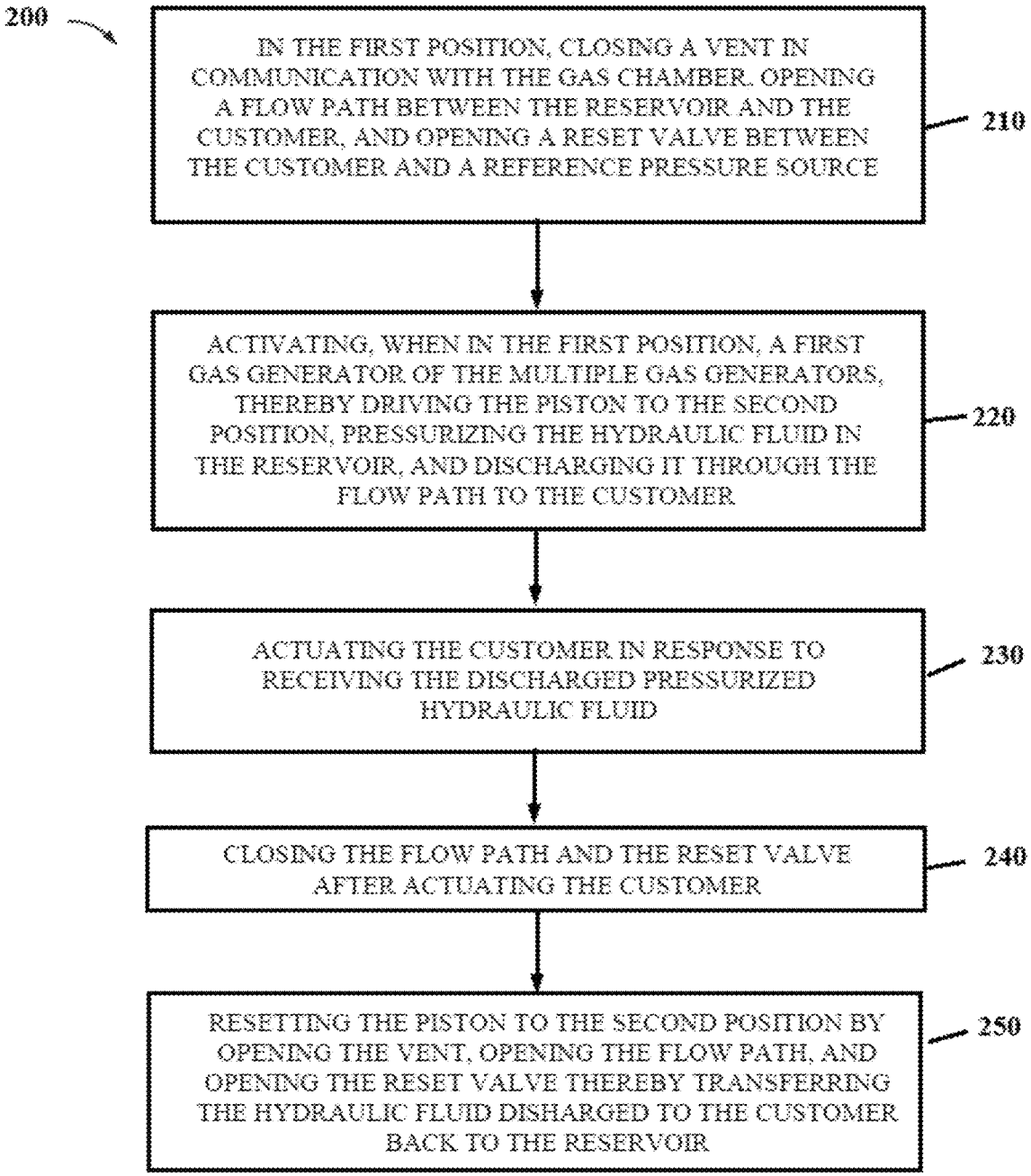
FIG. 13 illustrates another exemplary method of operating a gas generator driven pressure supply system according to one or more aspects of the disclosure.

FIG. 13 illustrates an exemplary method 200, which is described with reference to FIGS. 1-11. At block 210, with a pressure supply device 10 in the first position, closing a vent 26 in communication with gas chamber 18, opening a flow path between reservoir 16 and customer 22, and opening a reset valve 74 between customer 22 and a external hydraulic fluid source 28. At block 220, activating, when in the first position, a first gas generator 24 of the multiple gas generators producing gas 46 in gas chamber 18, thereby driving piston 14 to the second position, pressurizing hydraulic fluid 34 in reservoir 16 and discharging it through the flow path to customer 22. At block 230, actuating customer 22 in response to receiving the discharged pressurized hydraulic fluid 34. At block 240, closing the flow path, e.g., valve 70, and reset valve 74 after actuating the customer. At block 250, resetting piston 14 to the second position by opening vent 26, opening the flow path via valve 70, and opening reset valve 74, thereby transferring hydraulic fluid 34 discharged to customer 22 back to reservoir 16.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method, comprising:

using a pressure supply device (PSD) to actuate a hydraulic customer, the PSD comprising a cylinder extending from a first end to a discharge end, a moveable piston disposed in the cylinder and separating a reservoir from a gas chamber, multiple gas generators in communication with the gas chamber, the hydraulic customer in communication with the reservoir, wherein in a first position the piston is located proximate to the first end and the reservoir contains hydraulic fluid, and in a second position the piston is located proximate to the discharge end, the using comprising:

activating, when in the first position, a first gas generator of the multiple gas generators thereby driving the piston to the second position, pressurizing the hydraulic fluid, and discharging the pressurized hydraulic fluid to the customer;

actuating the customer in response to receiving the pressurized hydraulic fluid via a customer flow path between the reservoir and the customer;

resetting the piston to a first position by transferring a resetting hydraulic fluid into the reservoir via a reset flow path between the reservoir and an external fluid source comprising the resetting hydraulic fluid; and exhausting gas and condensate from the gas chamber in response to resetting the piston to the first position via a vent in communication between the gas chamber and a dump.

2. The method of claim 1, wherein the activating is performed on a demand to actuate the customer.

3. The method of claim 1, wherein the resetting hydraulic fluid is the pressurized hydraulic fluid discharged to the customer.

4. The method of claim 1, wherein the customer comprises the external hydraulic fluid source.

5. The method of claim 1, wherein the vent comprises a condensate trap.

6. The method of claim 1, wherein the reservoir is elevated relative to the gas chamber.

7. The method of claim 1, wherein the gas chamber is elevated relative to the reservoir.

8. The method of claim 1, wherein the gas chamber is elevated relative to the reservoir; and the vent comprises a condensate trap.

9. The method of claim 1, wherein in the first position the vent is closed, the reset flow path is closed, and the customer flow path is open;

closing the customer flow path after the actuating the customer and before the resetting; and the resetting comprising opening the vent and the reset flow path.

10. The method of claim 1, wherein the customer is a blowout preventer connected to a wellbore.

11. The method of claim 10, wherein in the first position the vent is closed, the reset flow path is closed, and the customer flow path is open;

closing the customer flow path after the actuating the blowout preventer and before the resetting; and the resetting comprising opening the vent and the reset flow path.

12. A method, comprising:

using a pressure supply device (PSD) to actuate a hydraulic customer, the PSD comprising a cylinder extending from a first end to a discharge end, a moveable piston disposed in the cylinder and separating a reservoir from a gas chamber, multiple gas generators in communication with the gas chamber, the hydraulic customer in communication with the reservoir, wherein in a first position the piston is located proximate to the first end and the reservoir contains hydraulic fluid, and in a second position the piston is located proximate to the discharge end, the using comprising:

activating, when in the first position, a first gas generator of the multiple gas generators thereby driving the piston to the second position, pressurizing the hydraulic fluid, and discharging the pressurized hydraulic fluid to the customer;

actuating the customer in response to receiving the pressurized hydraulic fluid via a flow path between the reservoir and the customer;

resetting the piston to first position by transferring a resetting hydraulic fluid into the reservoir via a reference pressure source in communication with the customer through a reset valve, wherein the resetting hydraulic fluid is the pressurized hydraulic fluid discharged to the customer; and exhausting gas and condensate from the gas chamber in response to resetting the piston to the first position via a vent in communication between the gas chamber and a dump.

13. The method of claim 12, wherein the dump is an enclosed vessel.

14. The method of claim 12, wherein in the first position the vent is closed, the reset valve is open, and the flow path is open.

15. The method of claim 12, wherein in the first position the vent is closed, the reset valve is open, and the flow path is open, and further comprising:

closing the flow path after the actuating the customer and before the resetting;

closing the reset valve after the actuating the customer and before the resetting; and the resetting comprising opening the reset valve, opening the flow path, and opening the vent.

16. The method of claim 15, wherein the dump is an enclosed vessel.

17. The method of claim 12, wherein the customer is a blowout preventer connected to a wellbore.

18. The method of claim 17, wherein in the first position the vent is closed, the reset valve is open, and the flow path is open, and further comprising:

closing the flow path after the actuating the blowout preventer and before the resetting;

closing the reset valve after the actuating the blowout preventer and before the resetting; and the resetting comprising opening the reset valve, opening the flow path, and opening the vent.

19. The method of claim 17, wherein the dump is an enclosed vessel.

20. The method of claim 17, wherein the vent comprises a condensate trap.

* * * * *